United States Patent [19]

Lorraine

[11] Patent Number: 4,583,736

[45] Date of Patent: Apr. 22, 1986

[54] NUMBER-COMBINATION SELECTOR

[76] Inventor: Anthony J. Lorraine, 303 College St., Chicopee, Mass. 01020

[21] Appl. No.: 772,864

[22] Filed: Sep. 5, 1985

[51] Int. Cl.[4] ..... A63F 9/00

[52] U.S. Cl. ..... 273/144 B; 273/144 A

[58] Field of Search ..... 273/144

[56] References Cited

U.S. PATENT DOCUMENTS

| | | | |
|---|---|---|---|
| 465,739 | 12/1891 | Guericke | 273/144 B |
| 2,315,323 | 3/1943 | Fostos | 273/144 A |
| 2,385,980 | 10/1945 | Fostos | 273/144 A X |
| 2,902,284 | 9/1959 | Massaro | 273/144 A |
| 3,140,875 | 7/1964 | Abbott et al. | 273/144 B |
| 3,371,932 | 3/1968 | Kranz | 273/144 A |
| 3,414,162 | 12/1968 | Leonforte | 221/301 X |
| 3,468,542 | 9/1969 | Ernst | 273/144 A |
| 4,185,828 | 1/1980 | Fernandez | 273/144 A X |
| 4,254,955 | 3/1981 | Dundon et al. | 273/144 A X |
| 4,273,335 | 6/1981 | Allonsius | 273/144 B |
| 4,280,702 | 7/1981 | Tremblay | 273/144 B |
| 4,373,728 | 2/1983 | Korzenietz | 273/144 B |
| 4,508,346 | 4/1985 | Salvucci | 273/144 B |

FOREIGN PATENT DOCUMENTS

| | | | |
|---|---|---|---|
| 565277 | 11/1932 | Fed. Rep. of Germany | 273/144 B |
| WO84/00115 | 1/1984 | PCT Int'l Appl. | 273/144 B |
| 649003 | 2/1979 | U.S.S.R. | 273/144 A |

*Primary Examiner*—Paul E. Shapiro

*Attorney, Agent, or Firm*—Donald S. Holland

[57] ABSTRACT

An apparatus for randomly selecting combinations of numbers for lottery-type games of chance. In the preferred embodiment, the invention comprises an adaptor hood which sits on a downsized, bingo-ball blower. The hood includes a lower access hole to receive lightweight numbered balls from an underlying blower chamber in which the balls are blown about; a spring-biased selector arm that normally straddles and blocks the hole, but which can be manually pivoted to allow a ball to pop up the hole and which can then be released to spring back and kick the ball away during its return movement; an adjacent inclined ramp that receives the kicked ball to feed it downwardly; and a clear display chute that catches the balls from the ramp and allows them to be viewed by a user.

To operate the selector, a player pulls a control end of the selector arm that extends beyond the hood. This causes a ball to be blown up into the adaptor hood and trapped under a finger mechanism. Release of the spring-biased selector arm causes a cap end of the arm to kick the selected ball onto the adjacent ramp, whereupon the ball rolls down into the display chute.

The player repeats the movement of the arm until the number of balls in the chamber reaches the desired number of combinations. After he reads the displayed numbers on the selected balls, the player automatically returns the balls into the blower through a re-entry gate.

12 Claims, 8 Drawing Figures

Fig.5.
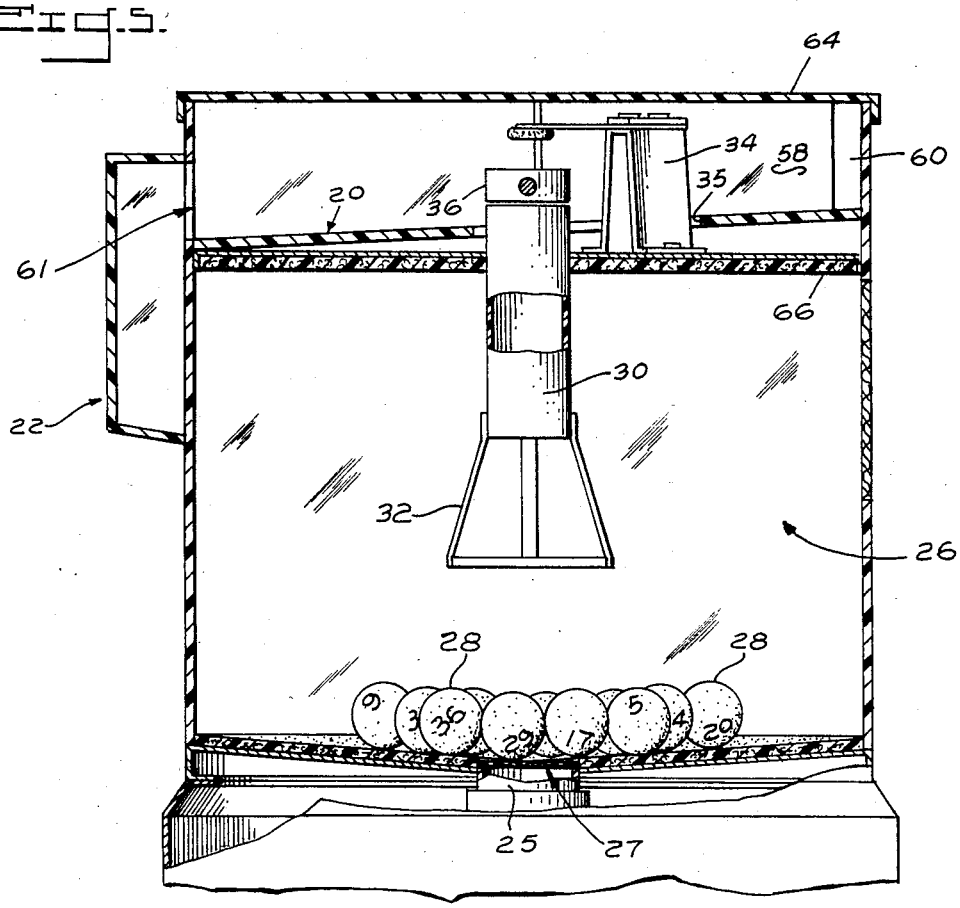
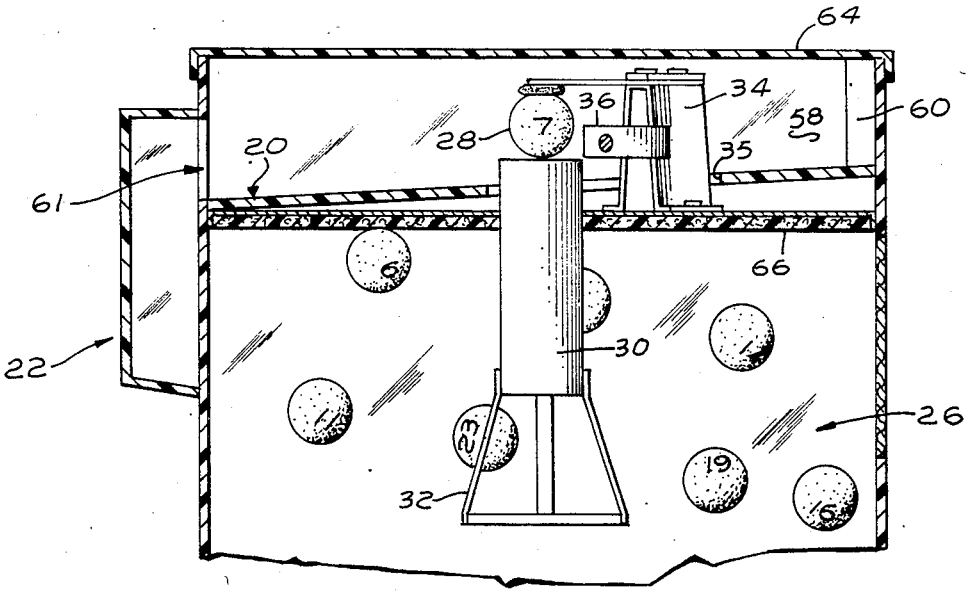
Fig.6.

Fig. 7.
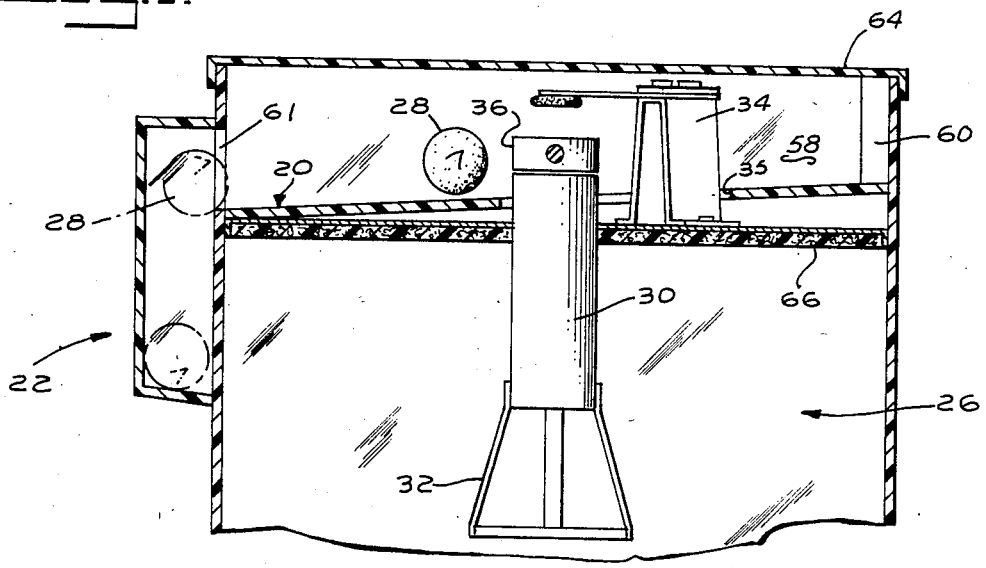
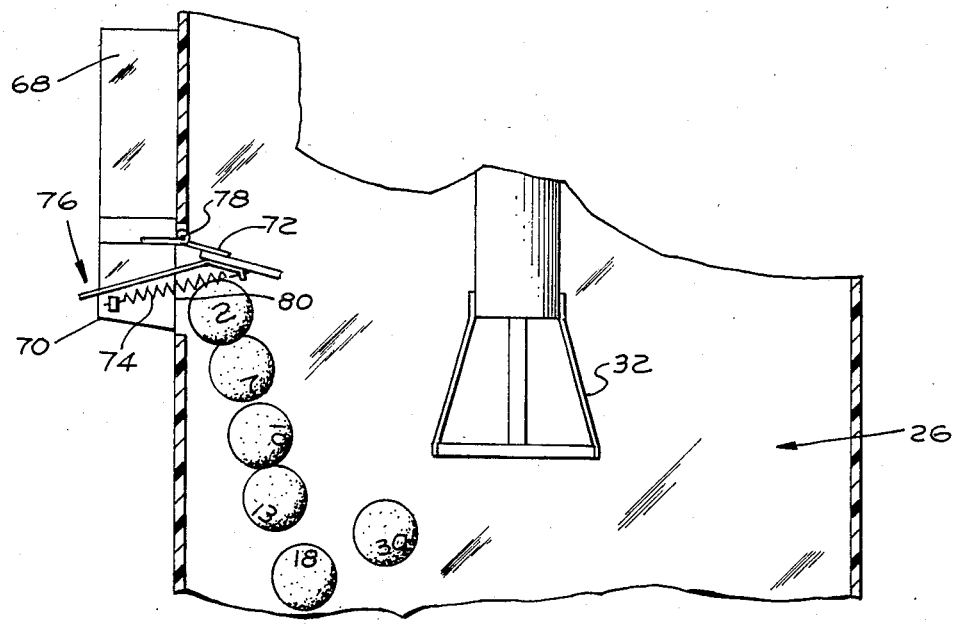
Fig. 8.

NUMBER-COMBINATION SELECTOR

BACKGROUND OF THE INVENTION

The present invention relates to devices for selecting numbers or combinations of numbers in games of chance.

Games of chance, wherein the players choose their own number or combinations of numbers, have become increasingly popular over the past few years. Governments, in order to increase revenue, frequently operate this type of game or lottery. The player receives a ticket with his selected number combination and the operator chooses a winning number on a weekly, daily or other basis. If the player's selected number combination matches the winning number, the player is a winner.

Some prizes in State lotteries have reached astronomical proportions. For example, one lottery winner was recently awarded over 16 million dollars. To cash in on this opportunity, players often select several combinations for one drawing. To do this, unprepared players often have to make a large number of selections in a relatively short time—that time being when the operator says, "Next! And what is your number?"

Players typically use various mathematical formulas or special numbers associated with birthdays, anniversaries and other meaningful dates. However, sometimes players lose faith in their numbers and look for any crutch or sign to assist them in winning.

Some devices have been previously developed which would allow random selection of combinations of numbers. Most of these selectors are hand-held and most are hand-agitated. Typically, an enclosed reservoir or chamber of number indicators, usually small numbered balls, is agitated or shaken by the player to insure a random array of the number indicators. Then the player opens a gate or slide which permits the number indicators to leave the holding reservoir or chamber to be physically withdrawn from the device or to be viewed within a display section of the device.

While such devices can select random number combinations relatively easily, none have gained widespread acceptance. One reason is that, although the devices are easily portable, lottery players rarely bring an apparatus to the site of the number combination selection. Additionally, these prior devices would be impractical if they were offered at the lottery "store" because their hand operation renders them subject to rapid wear or abuse, especially when their numbered balls have to be plucked and held by a user.

Accordingly, it is the primary object of the present invention to provide an improved number-combination selector which randomly selects number combinations from a closed reservoir or chamber without having to be hand agitated to produce the combinations.

It is another object to provide a lightweight, portable number-combination selector, wherein the number indicators are selected and stored for display in a clear sealed chute and then returned to the storage or agitation chamber without being touched by the player.

It is yet another object to provide a number-combination selector which is commensurate with the above-listed objects and comprises an adaptor hood that fits over a standard, underlying bingo-ball blower.

It is a still further object to provide a number-combination selector which is easily amenable to being operated as a commercial vending machine, wherein the player inserts a coin to start the device for a specific time period during which the player selects the combinations.

The above and other objects and advantages of this invention will become more readily apparent when the following description is read in conjunction with the accompanying drawings.

SUMMARY OF THE INVENTION

A simple apparatus is disclosed for randomly selecting number combinations to be used in lottery-type games of chance. This device automatically agitates a plurality of numbered balls for randomness and operates without exposing the balls to physical contact by the operator.

In the preferred embodiment, the invention comprises an adaptor hood which is affixed to a downsized, but otherwise standard, bingo-ball blower and a standard coin-operated vending mechanism. Once the operator starts the number-combination selector for its designated time period, the blower causes the small, light, numbered balls to move about randomly within a clear storage chamber.

When the user slightly pivots a selector arm, it opens the upper end of an annular sleeve, which extends from the underlying storage chamber into the adaptor hood. Compressed air escapes from the storage chamber and pushes up one of the balls to the sleeve's now-open end, where the ball is trapped in a stationary position by an overlying finger mechanism. Next, the operator releases the spring-biased selector arm, whereupon the trapped ball is kicked away from the trap finger and moves down a slope to roll into a clear display chute.

The operator then repeats the movement of the selector arm as many times as necessary to select the proper number of balls to complete his combination. Afterwards, he opens a re-entry gate, which allows the displayed balls to roll back into the storage chamber for subsequent reuse.

BRIEF DESCRIPTION OF THE DRAWINGS

FIG. 5 is a fragmentary cross-sectional view taken along line 5—5 of FIG. 3, showing the selector arm closed and the cover replaced;

FIG. 6 is similar to FIG. 5, but shows the selector arm open and a trap finger holding a "popped-up", numbered ball;

FIG. 7 is similar to FIG. 6, but shows the selector arm closed and the numbered ball moving toward the display chute; and FIG. 8 is a fragmentary side plan view taken along line 8—8 of FIG. 3, showing six previously selected balls leaving the display chute and re-entering the storage chamber of the selector.

DETAILED DESCRIPTION OF THE PREFERRED EMBODIMENTS

Figure 1:
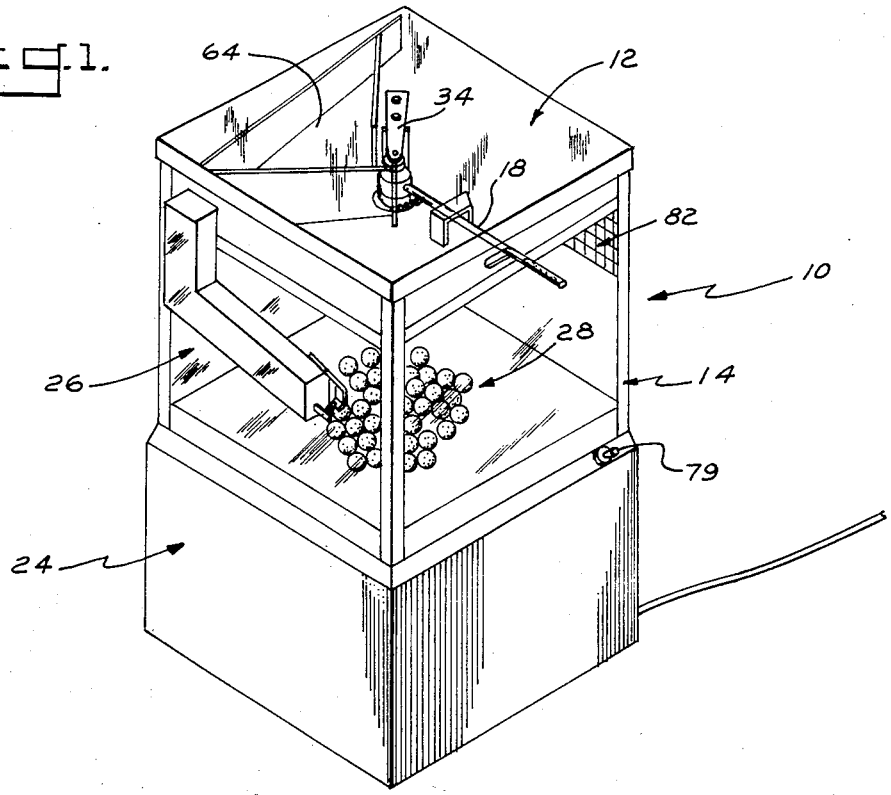
FIG. 1 is a top perspective view of a number-combination selector constructed in accordance with the present invention, wherein the selector is an adaptor hood affixed to an underlying, standard bingo-ball blower.

Referring to the drawings in detail, the preferred embodiment of a number-combination selector is shown and generally designated by the reference numeral 10. The invention basically comprises an adaptor hood 12 that fits over a downsized, but otherwise standard, bingo-ball blower 14 (see FIG. 1). As best shown in FIG. 2, the adaptor hood 12 includes an access hole 16 for receiving a ball from the blower 14; an overlying selector arm 18 adapted to seal the hole and knock the ball away from it; and an inclined ramp 20 on which the knocked ball travels to an underlying clear display chute 22.

The standard bingo-ball blower 14 includes a lower compartment 24 underlying a transparent enclosure or storage chamber 26. Within the lower compartment 24 is a series of standard, unshown components: an electric motor and fan which are connected to a duct 25 (see FIG. 5) that leads to a screened opening 27 in the bottom of chamber 26. Within the chamber 26 is a plurality of small, light, numbered balls 28 and a vertical tube 30 (see FIG. 2) that extends upwardly from the middle of the chamber 26 through its top. The bottom of the tube 30 has a frusto-conical spider guide 32 for guiding balls 28 into and through the tube 30. A finger trap mechanism 34 is affixed to the central top of the enclosure to control a ball 28 as it leaves the tube 30.

Figure 2:
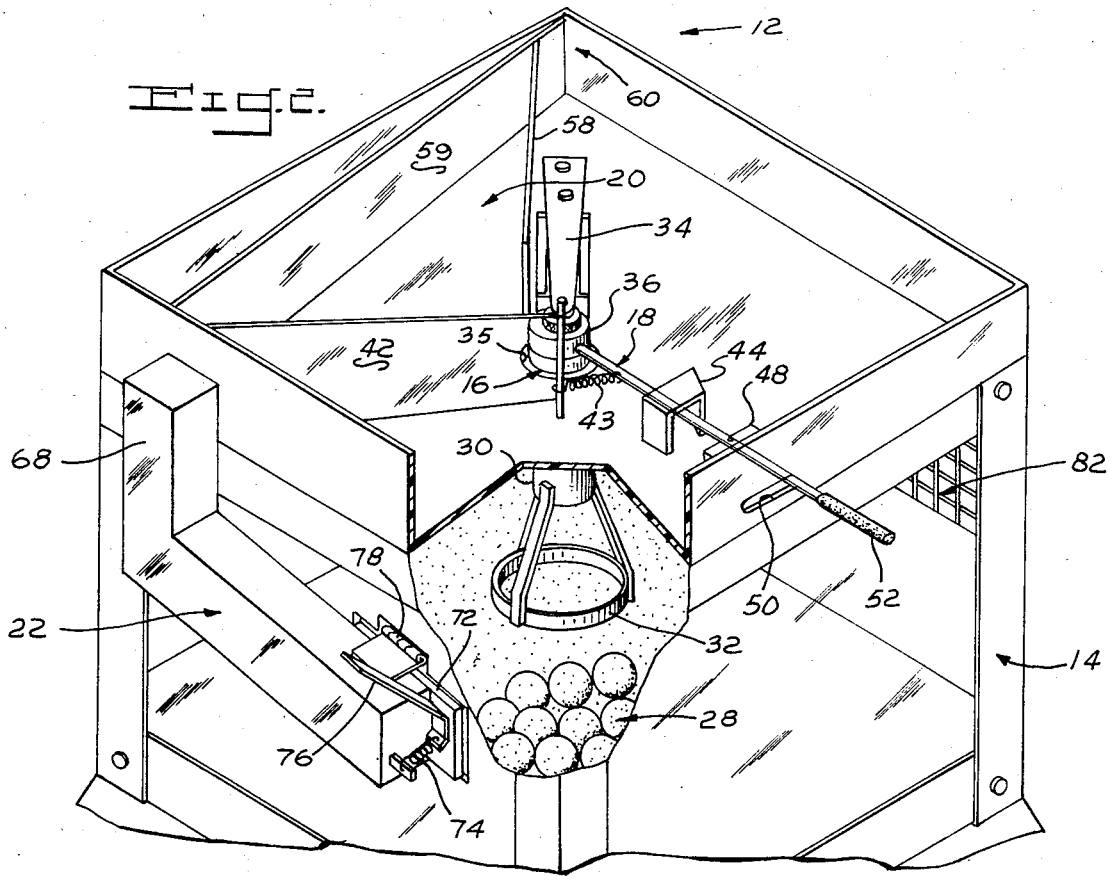
FIG. 2 is a fragmentary, top perspective view of the FIG. 1 selector, showing an adaptor hood with its cover removed for clarity.
Figure 3:
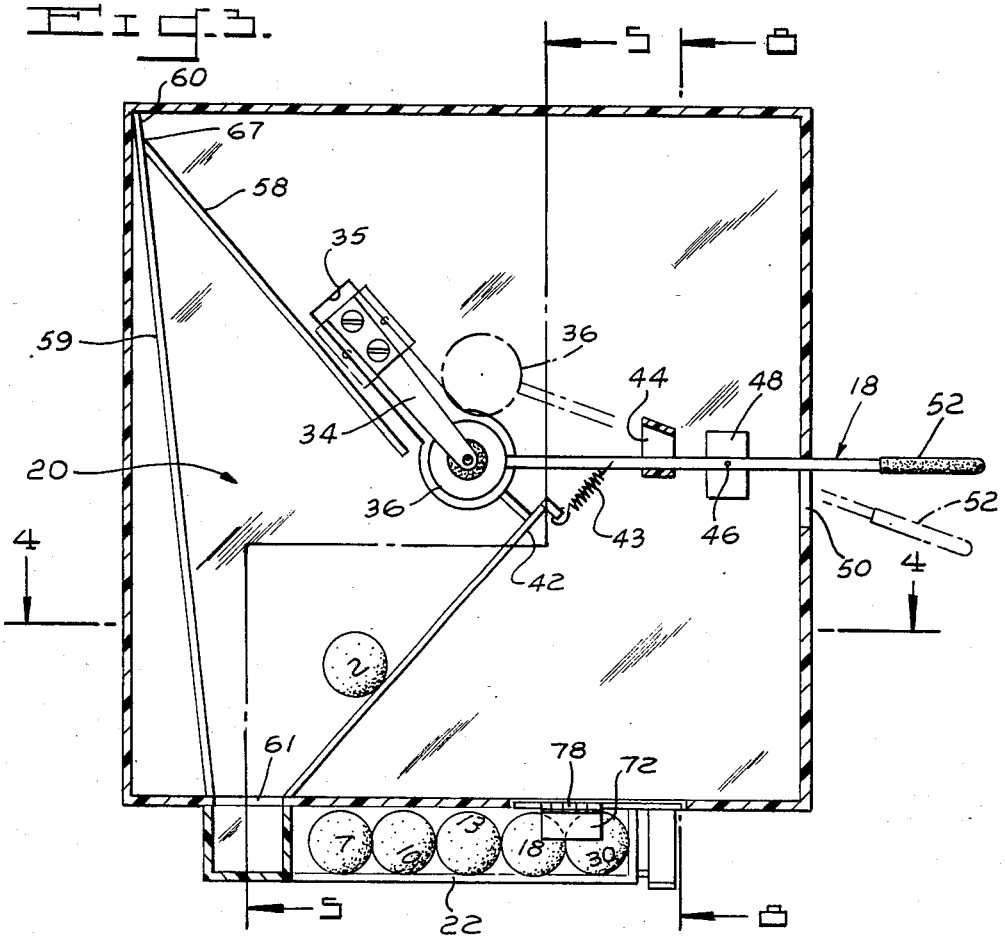
FIG. 3 is a top plan view of the number-combination selector shown in FIG. 1, with its cover removed and a phantom line indicating the "open" position of an illustrated selector arm.

The adaptor hood 12 sits on top of the bingo-ball blower 14 and is made of any suitable transparent material, such as PLEXIGLAS ®. As best shown in FIGS. 2 and 3, the bottom of hood 12 has a substantially pear-shaped cutout 35 that fits over the top of tube 30 and trap mechanism 34.

Overlying the tube 30 and cutout 35 is a cap end 36 of selector arm 18. Immediately behind the cap end 36, the selector arm is attached to a vertical guide wall 42 by a coil spring 43.

Moving along the selector arm 18, away from its cap end 36, the arm first passes through a fixed guide tunnel 44. This tunnel comprises an inverted U-shaped member which limits the arm's horizontal and vertical movement.

Moving further from cap end 36, the selector arm is next connected to a hinge pin 46. This pin passes through the selector arm 18 to a pivot post 48, upon which the arm rests and pivots through a horizontal plane.

Finally, the selector arm 18 passes through an elongated opening or slot 50 in the side of adaptor hood 12 and terminates in a final portion 52 that projects outside of the hood. This portion acts as a control end for a user to operate the device.

Ramp 20 is designed to guide a ball after it has been kicked away from tube 30 by selector arm 18. As best shown in FIGS. 2–3, the ramp 20 comprises a triangular base, with its sides or triangular legs being boundered by the guide wall 42 and two "inner" walls 58, 59.

One inner wall 58 leads horizontally from the hole 16, away from the selector arm and toward the back corner 60 of the adaptor hood 12 which is also an end of the other inner wall 59. Wall 59 leads horizontally from the back corner to an entrance 61 to the display chute 22.

These inner walls 58, 59, together with guide wall 42, extend upwardly from the ramp 20 to the underside of a removable top or cover 64 for the adaptor hood 12. Consequently, in addition to acting as a boundary for the ramp, they also act as a support for the top.

As best shown in the sequence of FIGS. 5–7, the triangular ramp 20 is partially elevated above a flat floor 66 of the hood. The ramp's lowest point is at chute entrance 61, while its highest point (boundered within walls 42, 58, 59) is at the intersection 67 of walls 58, 59. This creates an inclined plane so that a ball 28 will roll toward the entrance 61 to the display chute 22 from any point on the ramp 20.

Figure 4:
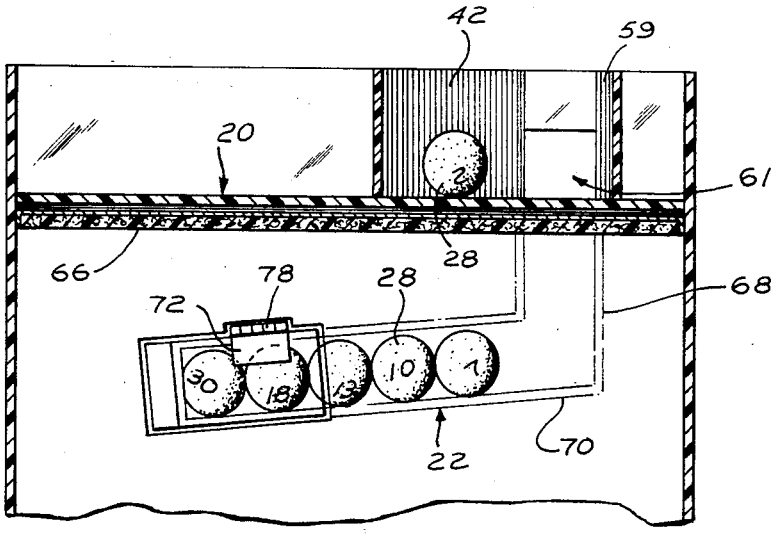
FIG. 4 is a fragmentary cross-sectional view taken along line 4—4 of FIG. 3, showing a clear display chute and a re-entry gate.

As best shown in FIGS. 1, 4 and 8, the display chute 22 comprises the entrance 61; a vertical drop sleeve 68 integrally attached to the floor 66 of hood 12; an elongated display chamber 70 connected to the bottom of the sleeve; a hinged gate 72 at the bottom of the display chamber 70; and a coil spring 74 between the gate 72 and the display chamber 70. The display chamber 70 is affixed to the vertical drop sleeve 68 and the floor 66 so that its lowest point is adjacent to its gate 72. The hinged gate 72 has a lever 76 that extends outwardly, away from the hood 12 and below the pivot axis 78 of the hinge.

Operation of the preferred embodiment is best shown in FIGS. 1–3 and 5–8. To initiate the operation, a player flips a standard switch 79 (see FIG. 1). The bingo-ball blower then begins to agitate the numbered balls 28 by blowing compressed, warm air into the bottom of storage chamber 26.

After the balls are moving sufficiently in the chamber, the player applies gentle pressure to the side of control end 52 of the spring-biased selector arm 18. This pressure causes the selector arm 18 to pivot horizontally on the pivot post 48, to the limit allowed by guide tunnel 44 (see the arm's phantom illustration in FIG. 3). During this movement, the arm's cap end 36 uncovers the access hole 16 which allows warm air to escape from the chamber 26 and rush through the tube 30. This onrushing air rapidly pushes a ball 28 through the tube and into the adaptor hood. When the ball pops through, it is stopped and basically held in place by the trap mechanism 34 (see FIG. 6).

Next, the player releases the control end 52 which allows the force of the coil spring 43 to snap the selector arm 18 back to its original or "closed" position, where it re-covers the tube. As the arm returns (see FIG. 7), its cap end 36 kicks the ball 28 out of the trap mechanism 34 and onto the inclined ramp 20. The ball 28 then moves by force of gravity down to the lowest point on the ramp, the entrance 61 to the display chute 22. Gravity continues to take the ball 28 down the vertical drop sleeve 68 and down to the bottom of the display chamber 70, adjacent to the hinged gate 72.

The player subsequently repeats the pivoting action of selector arm 18, as many times as necessary, to select the desired number or string of balls for a combination of numbers. Since the collected balls have their numbers repeated several times on their outer surfaces, their numbers are easy to read through display chamber 70.

After reading the numbers on the balls and thereby obtaining the "lottery number" on which to base that week's first hope, the player applies gentle pressure to the lever 76 of hinged gate 72. The gate opens into a rectangular opening 80 in the storage chamber 26 and the balls 28 re-enter the chamber (see FIG. 8). The number-combination selector is then ready to be used again.

In the preferred embodiment, the illustrated selector 10 includes a metal screen 82 on the side of its storage chamber 26 (see FIG. 1). This screen mesh vents the chamber to the atmosphere. Also, it can be slidably removed to make repairs or enable worn balls to be replaced in the chamber.

It should be noted that the illustrated trap mechanism 34 differs slightly from most standard trap mechanisms in that it fails to include any side clamp projections. It consists of an inverted L-shaped finger with a rubber stopper at its end for holding a ball 28.

In another preferred embodiment (not shown), the invention includes a standard timing mechanism to limit the available time for making a selection. This will prevent the player from wasting time awaiting a possible best moment to make a selection.

It should be understood by those skilled in the art that obvious structural modifications can be made without departing from the spirit of the invention. Accordingly, reference should be made primarily to the accompanying claims rather than the foregoing specification to determine the scope of the invention.

Having thus described the invention, what is claimed is:

1. In a bingo-ball-blower apparatus of the type used for randomly selecting numbers in a game of chance, wherein the apparatus includes a transparent storage chamber in which a plurality of lightweight numbered balls are initially blown about and the chamber has a selection tube that extends vertically upwardly through a ceiling of the chamber, whereby the tube can be vented to the atmosphere to permit balls to randomly rise through it, the improvement comprising a hood that fits atop the apparatus, wherein said hood includes a lower access hole through which an upper, open end of the tube extends; a spring-biased selector means that normally straddles and entirely blocks the tube's open end to prevent balls from rising through the tube, but which can be manually pivoted to uncover the open end and allow a ball to pop up the tube and which then can be released to spring back and kick the ball away from an overlying finger trap mechanism during its return movement; an inclined ramp that is adjacent to the tube's upper end and which is adapted to receive the kicked ball to feed it downwardly; and a clear display chute that is adapted to catch the ball from the ramp and allow it to be viewed by a user.

2. The apparatus of claim 1 wherein the selector means comprises an elongated arm that is pivotally mounted, along its midlength, to the hood and attached to a coil spring, wherein said arm has a cap at one end that is adapted in size and shape to completely block the tube's open end and to thereby prevent air from rushing through the tube and said arm further has an opposite, control end that extends through a horizontal slot in the hood.

3. The apparatus of claim 2 wherein the trap mechanism comprises an inverted L-shaped finger having a horizontal portion that overlies both the open end of the tube and the arm's cap end, said horizontal portion having an attached, underlying rubber stop that is adapted to hold a ball between the tube's open end and the stop when the selector arm is pivoted to unblock the tube's open end.

4. The apparatus of claim 3 wherein the chute includes a hinged gate that normally blocks an opening between the chute and the storage chamber, wherein the gate has a spring-biased lever that can be pivoted to swing open the gate and thus unblock the opening to permit a displayed ball in the chute to re-enter the storage chamber.

5. An apparatus comprising:

a. transparent box-like enclosure in which a plurality of lightweight balls are stored, said enclosure having a top, bottom and four sides;

b. an electrically operated fan connected in fluid communication with an opening in the bottom of the enclosure, whereby air from the fan blows the balls about randomly within the enclosure;

c. an open-ended vertical tube that extends upwardly from the interior of the enclosure through its top, wherein a bottom end portion of the tube includes a frusto-conical guide for guiding balls into and through the tube;

d. a trap mechanism that is affixed to the top of the enclosure to control a ball as it leaves a top portion of the tube, wherein the trap mechanism comprises an inverted L-shaped finger with the horizontal portion of the "L" being spaced apart from and overlying the open top end of the tube that extends through the enclosure's top;

e. a spring-biased, pivotable, elongated selector arm having an integral end portion that is designed in size and shape to normally straddle and block the tube's open top end to prevent balls from rising through the tube, whereby said arm can be manually pivoted to uncover the tube's upper end and allow a ball to pop up the tube and then can be released to spring back and kick the ball away from the overlying finger trap mechanism during the arm's return movement;

f. an inclined ramp that is adjacent the tube's upper end, which receives the kicked ball to feed it downwardly; and g. a clear display chute that catches the balls from the ramp and allows them to be viewed by a user, wherein the chute includes a hinged gate that normally blocks an opening between the chute and the enclosure, and the gate has a spring-biased lever that can be pivoted to swing open the gate and thus unblock the opening to permit a displayed ball in the chute to re-enter the enclosure.

6. The apparatus of claim 5 wherein the fan includes an attached timer mechanism for controlling the period the fan is electrically turned on.

7. An apparatus comprising:

a. a transparent box-like enclosure in which a plurality of lightweight balls are stored, said enclosure having a top, bottom and four sides;

b. an electrically operated fan connected in fluid communication with an opening in the bottom of the enclosure, whereby air from the fan blows the balls about randomly within the enclosure;

c. an open-ended vertical tube that extends upwardly from the interior of the enclosure through its top;

d. a spring-biased selector means that normally straddles and entirely blocks the tube's open end to prevent balls from rising through the tube, but which can be manually pivoted to uncover the open end and allow a ball to pop up the tube and which then can be released to spring back and kick the ball away from an overlying finger trap mechanism during its return movement;

e. an inclined ramp that is adjacent to the tube's upper end and which receives the kicked ball to feed it downwardly; and f. a clear display chute that catches the balls from the ramp and allows them to be viewed by a user.

8. The apparatus of claim 7 wherein the selector means comprises an elongated arm that is pivotally mounted, along its midlength, to the hood and attached to a coil spring, wherein said arm has a cap at one end that is adapted in size and shape to completely block the tube's open end and to thereby prevent air from rushing through the tube and said arm further has an opposite, control end that extends through an elongated slot and beyond the enclosure's top.

9. The apparatus of claim 8 wherein the trap mechanism comprises an inverted L-shaped finger, wherein the horizontal portion of the "L" overlies both the open end of the tube and the arm's cap end, said horizontal portion having a rubber stop that is adapted to hold a ball between the tube's open end and the stop when the selector arm is pivoted to unblock the tube's open end.

10. The apparatus of claim 9 wherein the chute includes a hinged gate that normally blocks an opening between the chute and the storage chamber, wherein the gate has a spring-biased lever that can be pivoted to swing open the gate and thus unblock the opening to permit a displayed ball in the chute to re-enter the storage chamber.

11. A method of randomly selecting numbers in a game of chance, said method comprising:

a. blowing a plurality of lightweight, numbered balls within the enclosed storage chamber of a bingo-ball blower;

b. blocking the upper open end of a vertical discharge tube of the blower with an overlying, spring-biased selector arm to prevent the balls from rising up the tube;

c. pivoting and holding the selector arm away from the tube to unblock the tube's open upper end and allow a ball to pop up the tube;

d. releasing the arm to allow it to spring back to its position described in step b so that it kicks a ball away from the tube's upper end and onto an adjacent ramp; and e. feeding the ball downwardly, via gravity, from the ramp into a display chute that catches the ball and allows it to be viewed by a user.

12. The method of claim 10 wherein the arm is pivoted as many times as necessary to select a desired number of balls to be viewed in the chute.

* * * * *